US012408705B2

(12) United States Patent
Li

(10) Patent No.: US 12,408,705 B2
(45) Date of Patent: Sep. 9, 2025

(54) ELECTRONIC VAPORIZATION DEVICE HAVING A HEAT SHIELD WITH AIRFLOW CHANNEL

(71) Applicant: Shenzhen Verdewell Technology Limited, Guangdong (CN)

(72) Inventor: Yuanjian Li, Shenzhen (CN)

(73) Assignee: Shenzhen Verdewell Technology Limited, Shenzhen (CN)

( * ) Notice: Subject to any disclaimer, the term of this patent is extended or adjusted under 35 U.S.C. 154(b) by 419 days.

(21) Appl. No.: 18/077,700

(22) Filed: Dec. 8, 2022

(65) Prior Publication Data

US 2023/0180844 A1 Jun. 15, 2023

(30) Foreign Application Priority Data

Dec. 15, 2021 (CN) ..... 202123174215.X

(51) Int. Cl.

| | |
|---|---|
| ***A24F 40/485*** | (2020.01) |
| ***A24F 40/42*** | (2020.01) |
| ***A24F 40/46*** | (2020.01) |
| ***A24F 40/51*** | (2020.01) |

(52) U.S. Cl.

CPC ..... *A24F 40/485* (2020.01); *A24F 40/42* (2020.01); *A24F 40/46* (2020.01); *A24F 40/51* (2020.01)

(58) Field of Classification Search

CPC ..... A24F 40/485; A24F 40/46; A24F 40/42
See application file for complete search history.

(56) References Cited

U.S. PATENT DOCUMENTS

| | | | | |
|---|---|---|---|---|
| 2019/0191769 | A1 | 6/2019 | Qiu | |
| 2022/0053830 | A1* | 2/2022 | Zhu | C04B 41/4572 |
| 2022/0400758 | A1* | 12/2022 | Wang | A24F 40/485 |
| 2023/0180844 | A1 | 6/2023 | Li | |
| 2023/0218005 | A1* | 7/2023 | Liu | A24F 40/10 131/329 |
| 2023/0404158 | A1* | 12/2023 | Liu | A24F 40/46 |

FOREIGN PATENT DOCUMENTS

| | | | |
|---|---|---|---|
| CN | 204070571 U | | 1/2015 |
| CN | 206005956 U | | 3/2017 |
| CN | 208064477 U | * | 11/2018 |
| CN | 211910544 U | | 11/2020 |
| WO | 2019047204 A1 | | 3/2019 |

OTHER PUBLICATIONS

Canadian Intellectual Property Office, Office Action in Canadian Patent Application No. 3,185,936 (May 23, 2024).
Canadian Intellectual Property Office, Office Action in Canadian Patent Application No. 3,185,112 (Feb. 28, 2024).

* cited by examiner

*Primary Examiner* — Hae Moon Hyeon
(74) *Attorney, Agent, or Firm* — Leydig, Voit & Mayer, Ltd.

(57) ABSTRACT

An electronic vaporization device includes: a housing; a vaporization assembly arranged in the housing, the vaporization assembly having a vaporization base; a heat shield arranged in the vaporization base; and a heating pot arranged in the heat shield. An airflow channel for ambient air to enter the heating pot is formed on an outer surface of the heat shield.

16 Claims, 10 Drawing Sheets

ELECTRONIC VAPORIZATION DEVICE HAVING A HEAT SHIELD WITH AIRFLOW CHANNEL

CROSS-REFERENCE TO PRIOR APPLICATION

Priority is claimed to Chinese Patent Application No. 202123174215.X, filed on Dec. 15, 2021, the entire disclosure of which is hereby incorporated by reference herein.

FIELD

The present disclosure relates to the field of vaporization, and more specifically, to an electronic vaporization device.

BACKGROUND

In the related art, when a baking-type electronic vaporization device operates, an aerosol-forming substrate (for example, a vaporizable medium such as plant grass, tobacco paste, or shredded tobacco) filled in a heating pot is heated to generate vapor. A user sucks on a suction nozzle, inhales external air into the electronic vaporization device, and the external air passes through the heating pot, thereby driving the vapor into the mouth of the user.

Because the air inhaled into the electronic vaporization device is ambient air (normal temperature), when the air comes into contact with the vapor in the heating pot, the air causes the vapor/heating pot to cool down. Or in more serious cases, the air causes the vapor to condense, affecting the taste of inhaling or leading to low efficiency of heating and vaporization.

In addition, in the related art, when some baking-type electronic vaporization devices operate, the temperature of the surface of the housing is very high, which makes the user feel hot and brings a poor user experience.

SUMMARY

In an embodiment, the present invention provides an electronic vaporization device, comprising: a housing: a vaporization assembly arranged in the housing, the vaporization assembly comprising a vaporization base: a heat shield arranged in the vaporization base; and a heating pot arranged in the heat shield, wherein an airflow channel for ambient air to enter the heating pot is formed on an outer surface of the heat shield.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
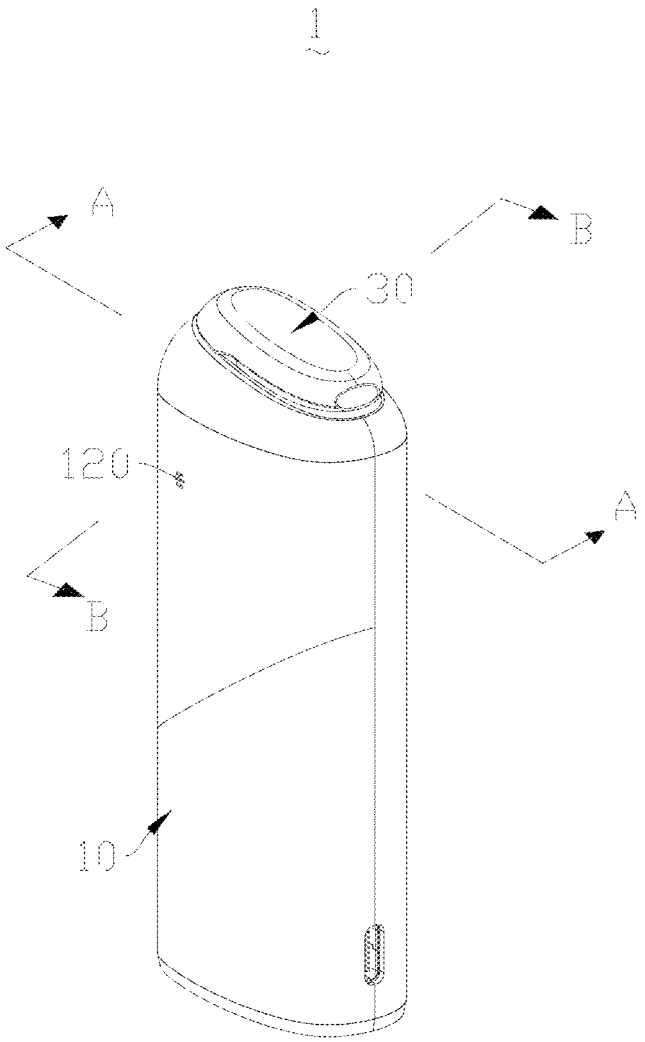
FIG. 1 is a three-dimensional schematic structural diagram of an electronic vaporization device according to some embodiments of the present disclosure.
Figure 2:
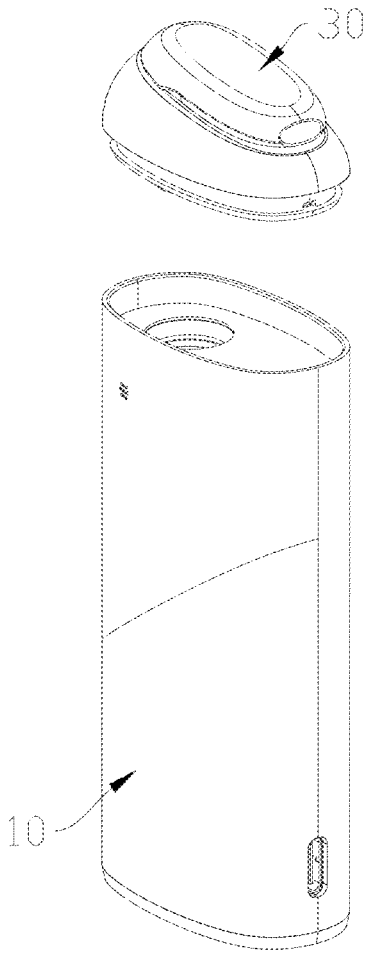
FIG. 2 is a schematic diagram of a three-dimensional exploded structure of the electronic vaporization device shown in FIG. 1.
Figure 3:
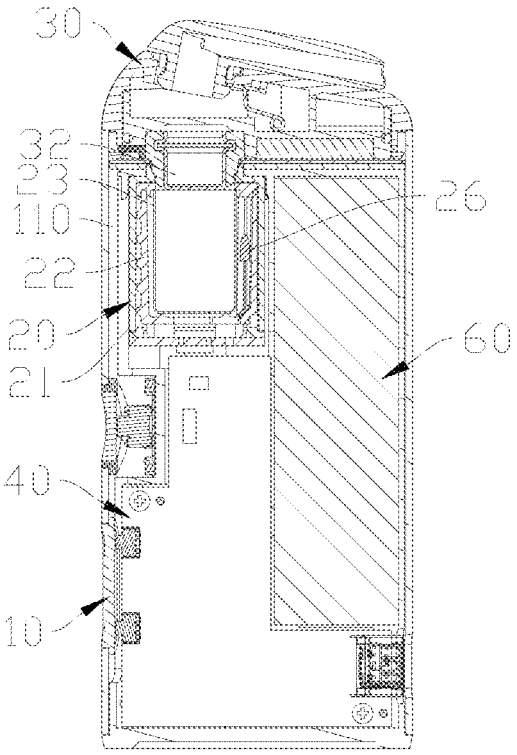
FIG. 3 is a schematic cross-sectional structural diagram in an A-A direction of the electronic vaporization device shown in FIG. 1.
Figure 4:
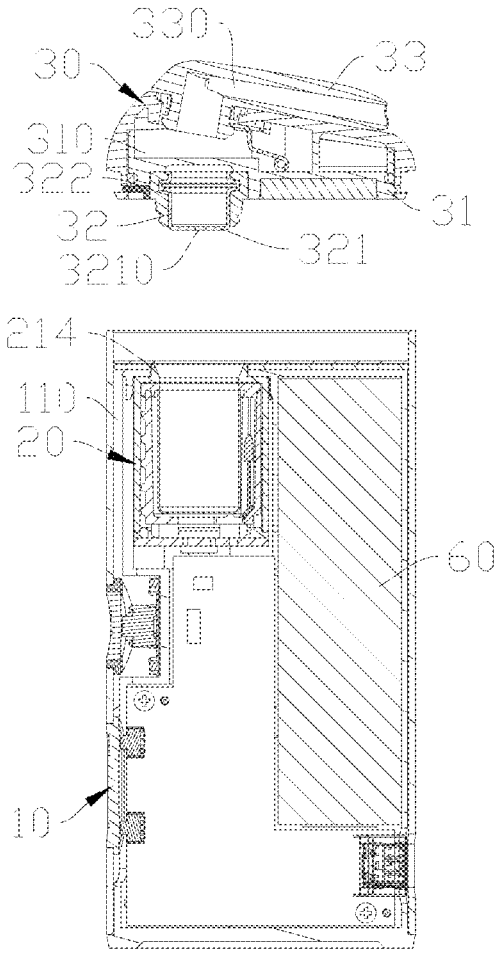
FIG. 4 is a schematic cross-sectional structural diagram in an A-A direction of the electronic vaporization device in a disassembled status shown in FIG. 1.

In an embodiment, the present invention provides an improved electronic vaporization device.

In an embodiment, the present invention provides an electronic vaporization device, including a housing and a vaporization assembly arranged in the housing, where the vaporization assembly includes a vaporization base, a heat shield arranged in the vaporization base, and a heating pot arranged in the heat shield, and an airflow channel for ambient air to enter the heating pot is formed on an outer surface of the heat shield.

In some embodiments, the airflow channel is distributed over most areas of the outer surface of the heat shield.

In some embodiments, the airflow channel extends from an upper end to a lower end of the heat shield.

In some embodiments, the airflow channel is distributed in an S shape on the outer surface of the heat shield.

In some embodiments, the heat shield includes a cylindrical first side wall, the airflow channel includes a plurality of C-shaped air guide grooves spaced apart in parallel in a longitudinal direction of an outer surface of the first side wall, and the air guide grooves are connected end to end.

In some embodiments, the first side wall includes a main body portion with a C-shaped cross section and a protruding portion with a U-shaped cross section that is mouth-to-mouth combined with the main body portion, and the plurality of C-shaped air guide grooves are formed in a longitudinal direction of an outer surface of the main body portion.

In some embodiments, the vaporization assembly includes a temperature sensing element, the heating pot includes a cylindrical second side wall, and the second side wall is axially arranged in the first side wall; and the temperature sensing element is arranged between the second side wall and the first side wall, and is arranged in a space defined by the protruding portion.

In some embodiments, the vaporization base includes a cylindrical third side wall, and a first air inlet hole that is in communication with the airflow channel is provided on the third side wall and at a position close to an upper end of the third side wall.

In some embodiments, the housing is provided with a second air inlet hole that is in communication with the first air inlet hole.

In some embodiments, an outer surface of the third side wall is provided with a seal base surrounding the first air inlet hole; and the vaporization assembly includes a first seal ring embedded in the seal base, and the first seal ring causes the first air inlet hole to be in communication with the second air inlet hole in a sealing and air guiding manner.

In some embodiments, the vaporization base includes an annular plate-shaped top wall that is integrally connected to the upper end of the third side wall and a plate-shaped bottom wall that is in snap-fit connection to a lower end of the third side wall, and the upper end and the lower end of the heat shield respectively abut against the top wall and the bottom wall.

In some embodiments, the heat shield includes a cylindrical first side wall and a first bottom wall combined a lower end of the first side wall, and an upper surface of the first bottom wall is provided with a thermal insulation protrusion configured to support the heating pot.

In some embodiments, the heat shield includes a cylindrical first side wall, and the heating pot includes a cylindrical second side wall; and the second side wall is axially arranged in the first side wall, and a spacing is formed between an outer surface of the second side wall and an inner surface of the first side wall.

In some embodiments, an outer surface of the heating pot is provided with a heating circuit, and an inner surface of the heating pot is provided with an infrared radiation coating layer.

In some embodiments, the electronic vaporization device further includes a suction nozzle assembly, where the suction nozzle assembly is detachably connected to the housing and is connected to the heating pot in an air guiding manner.

In some embodiments, the vaporization assembly is detachably connected to the housing.

In some embodiments, the vaporization base includes a cylindrical third side wall and a plurality of elongated engagement protrusions with a wedge-shaped cross section, each of the engagement protrusion includes a helically inclined top surface, and the engagement protrusions are spaced apart in a circumferential direction of an outer wall surface of the third side wall that is close to an upper end of the third side wall, so as to be detachably and rotatably connected to the housing.

In some embodiments, the housing includes a holder, the holder includes an upper end cap, a plurality of arc-shaped buckles are protruded from a lower side of the upper end cap, and the buckles encircle to be respectively rotatably connected to the plurality of engagement protrusions.

The beneficial effects of the present disclosure are: because the outer surface of the heat shield is provided with an airflow channel for ambient air to enter the heating pot, on the one hand, the heat shield can be effectively cooled to reduce the heat transferred to the outer surface of the housing; and on the other hand, when the heated air enters the heating pot again, the condensation phenomenon in the heating pot can be reduced.

To provide a clearer understanding of the technical features, objectives, and effects of the present disclosure, specific implementations of the present disclosure are described with reference to the accompanying drawings.

FIG. 1 to FIG. 4 show an electronic vaporization device 1 according to some embodiments of the present disclosure. The electronic vaporization device 1 can be configured to heat an aerosol-generation substrate such as plant grass, tobacco paste, or shredded tobacco, so as to generate an aerosol for a user to inhale. As shown in the figure, the electronic vaporization device 1 can be in a flat cylindrical shape, which can include a flat cylindrical housing 10 with a racetrack-shaped cross-section, a cylindrical vaporization assembly 20 arranged in the housing 10, and a suction nozzle assembly 30 that is detachably connected to one end of the housing 10 in an axial direction and is connected to the vaporization assembly 20 in an air guiding manner. The housing 10 is configured to provide a carrier for components therein and to protect the components arranged therein. The vaporization assembly 20 is configured to accommodate and heat the aerosol-generation substrate to generate the aerosol. The suction nozzle assembly 30 is configured to discharge a mixture of the aerosol and air generated by the vaporization assembly 20 for the user to inhale. It can be understood that the housing 10 is not limited to be a flat cylindrical shape, and can also be a cylindrical shape, a square cylindrical shape, or an irregular shape.

In some embodiments, the electronic vaporization device 1 may further include a main control board 40, a microphone assembly 50, and a power source device 60, and the main control board 40 is configured to control the operation of the entire electronic vaporization device 1. The microphone assembly 50 is electrically connected to the main control board 40 and is connected to the vaporization assembly 20 in an air guiding manner, so as to inhale airflow in the vaporization assembly 20, and to be connected to the power source device 60. The power source device 60 is configured to supply electric power to electronic components such as the vaporization assembly 20, the main control board 40, and the microphone assembly 50.

Figure 5:
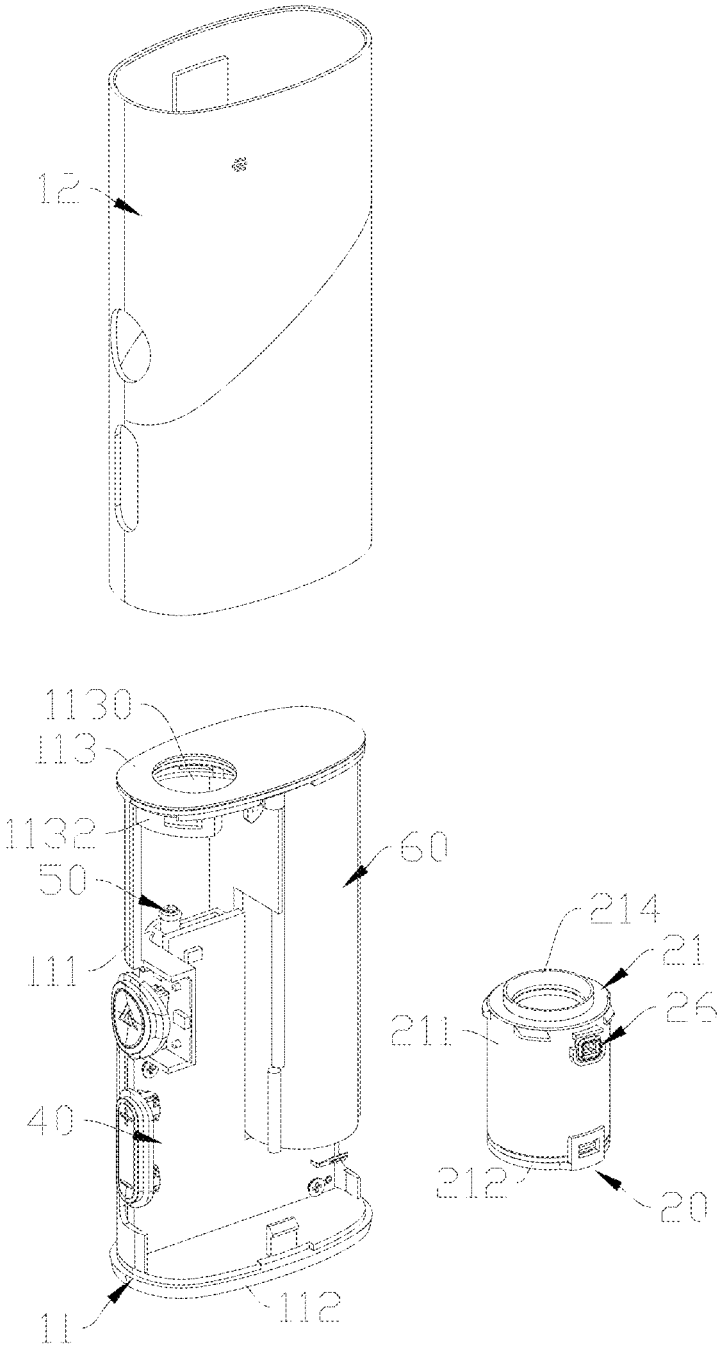
FIG. 5 is a schematic diagram of a three-dimensional exploded structure of the electronic vaporization device shown in FIG. 1 with a suction nozzle assembly removed.

Referring to FIG. 5, in some embodiments, the housing 10 may include a holder 11 and a sleeve 12 sleeved on the holder 11. The holder 11 is configured to provide support for components such as the vaporization assembly 20, the main control board 40, the microphone assembly 50, and the power source device 60. The sleeve 12 is sleeved on the holder 11 in the axial direction, and is configured to protect components on the holder 11, and in some embodiments, a cross section of the sleeve 12 can be in the shape of a racetrack.

In some embodiments, the holder 11 may include an elongated holder body 111, a lower end cap 112 integrally connected to a lower end of the holder body 111, and an upper end cap 113 integrally connected to an upper end of the holder body 111. In some embodiments, the lower end cap 112 and the upper end cap 113 may be in the shape of a racetrack-shaped flat plate, and the lower end cap 112 and the upper end cap 113 are perpendicular to a longitudinal axis of the holder body 111. The lower end cap 112 and the upper end cap 113 are respectively blocked on a lower end opening and an upper end opening of the sleeve 12 to define a sealed cavity 110 to accommodate electronic components such as the vaporization assembly 20, the main control board 40, and the microphone assembly 50. A plurality of air inlet holes 120 configured to cause the cavity to be in communication with the outside may be provided on the sleeve 12 and at a position close to an upper end of the sleeve 12. The air inlet holes 120 cause the vaporization assembly 20 to be in communication with the outside, so that ambient air can enter the vaporization assembly 20.

In some embodiments, the upper end cap 113 may include a vent hole 1130 running through in an up-down direction, and the vent hole 1130 is in communication with the vaporization assembly 20 to cause a mixture of the aerosol generated by the vaporization assembly 20 and air to be discharged. In some embodiments, the upper end cap 113 may include a plurality of arc-shaped buckles 1132 protruding on a lower side. The plurality of buckles 1132 encircle to cause the upper end of the vaporization assembly 20 to be rotatably connected to the plurality of buckles 1132, so as to cause the vaporization assembly 20 to be fixed with the upper end cap 113. In some embodiments, the upper end of the vaporization assembly 20 can be detachably screwed on the buckle 1132, so that the upper end of vaporization assembly can be replaced when the vaporization assembly 20 is damaged.

As shown in FIG. 6 to FIG. 9, in some embodiments, the vaporization assembly 20 may include a cylindrical vaporization base 21 mounted on a lower side of the upper end cap 113, a cylindrical heat shield 22 mounted in the vaporization base 21 in the axial direction, a cylindrical heating pot 23 mounted in the heat shield 22 in the axial direction, a seal ring 24 mounted between a top wall 213 of the vaporization base 21 and the upper end of the heat shield 22 and the upper end of the heating pot 23, and a seal ring 25 mounted on a side wall 211 of the vaporization base 21 and a temperature sensing element 26. The vaporization base 21 is configured to carry the heat shield 22 and the heating pot 23, and the heat shield 22 is configured to prevent the excessive heat released by the heating pot 23 from being transferred to surrounding electronic components. The heating pot 23 is configured to accommodate and heat the aerosol-generation substrate to generate the aerosol. The seal ring 24 is configured to seal and position the upper end of the heat shield 22 and the upper end of the heating pot 23. The seal ring 25 is configured to cause the air inlet hole 2110 on an upper portion of the side wall 211 of the vaporization base 21 to be in communication with the air inlet hole 120 on the sleeve 12 of the housing 10 in a sealing and air guiding manner (as shown in FIG. 10). The temperature sensing element 26 is arranged between the heat shield 22 and the heating pot 23, and is configured to sense a temperature of a periphery of the heating pot 23 to provide a temperature signal to a control system, preventing the temperature of the heating pot 23 from being too high or too low during operation.

Figure 7:
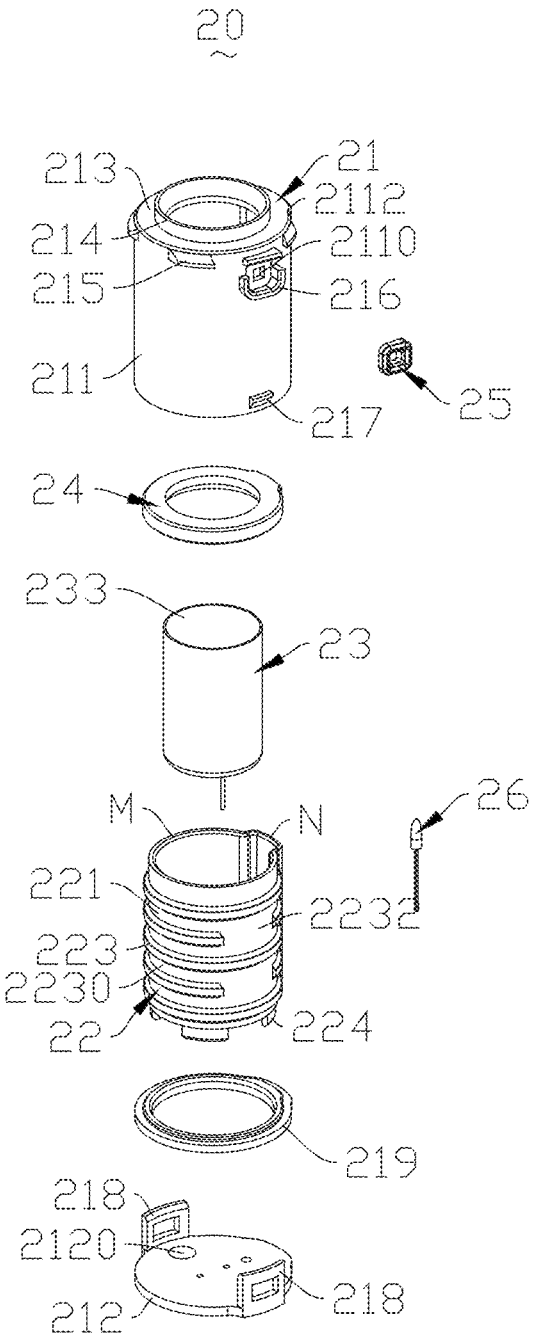
FIG. 7 is a schematic diagram of a three-dimensional exploded structure of the vaporization assembly shown in FIG. 5.
Figure 8:
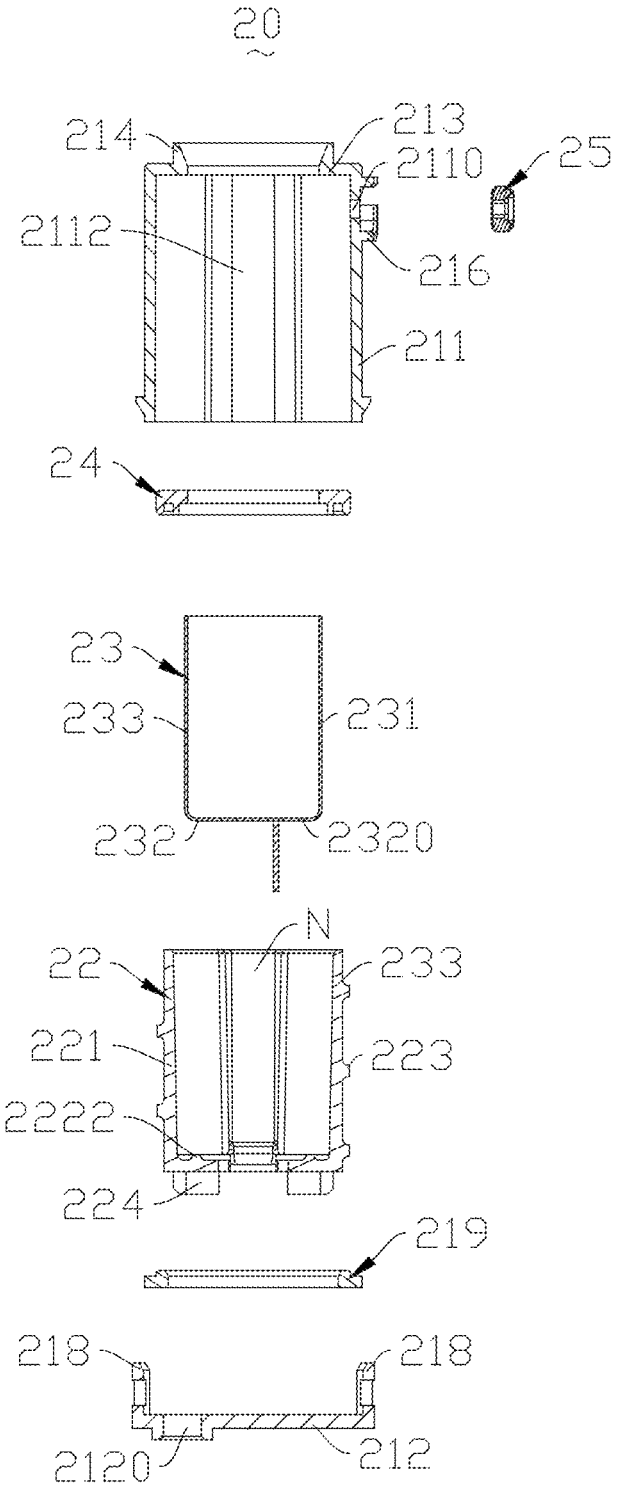
FIG. 8 is a schematic cross-sectional structural diagram of the vaporization assembly in a disassembled status shown in FIG. 7.

Referring to FIG. 7, in some embodiments, the vaporization base 21 may include a cylindrical side wall 211 made of a high temperature-resistant plastic material, a plate-shaped bottom wall 212 that is in snap-fit connection to a lower end of the side wall 211, an annular plate-shaped top wall 213 that is integrally connected to the upper end of the side wall 211, and a cylindrical neck 214 that is integrally connected to a top portion of the top wall 213. The side wall 211, the bottom wall 212, and the top wall 213 together define a cylindrical accommodating space configured to accommodate the heat shield 22 and the heating pot 23 therein. The neck 214 surrounds a central through hole of the top wall 213 and is embedded in the vent hole 1130 of the upper end cap 113, and is connected to the suction nozzle assembly 30 in a mechanical, air guiding, and detachable manner. The bottom wall 212 is detachably connected to the side wall 211, to accommodate the heat shield 22 and the heating pot 23 first.

In some embodiments, the vaporization base 21 may include a plurality of elongated engagement protrusions 215 with a wedge-shaped cross section, and each of the engagement protrusion 215 includes a helically inclined top surface. The engagement protrusions 215 are spaced apart in a circumferential direction of the outer wall surface of the upper end of the side wall 211, and can be respectively rotatably connected to (similar to threaded connection) a plurality of buckles 1132 of the upper end cap 113, so as to implement the detachable connection between the vaporization base 21 and the upper end cap 113.

In some embodiments, an air inlet hole 2110 running through in a thickness direction may further be provided on the side wall 211 and at a position close to an upper end of the side wall 211. In some embodiments, the vaporization base 21 may include a seal base 216 integrally formed on the outer surface of the side wall 211 and surrounding the air inlet hole 2110. The seal base 216 defines a square accommodating cavity for the seal ring 25 to be embedded therein. In some embodiments, the side wall 211 may further include an outer protruding portion 2112 to cooperate with a protruding portion N of the heat shield 22.

In some embodiments, the vaporization base 21 may include a pair of bosses 217 respectively arranged on two opposite outer surfaces of the lower end of the side wall 211, for the bottom wall 212 to be in snap-fit connection with the bosses. In some embodiments, the vaporization base 21 may include a pair of buckling arms 218. The pair of buckling arms 218 are respectively arranged on two opposite sides of the bottom wall 212 and protrude upward to be respectively in snap-fit connection with the pair of bosses 217 on the side wall 211, so as to implement snap-fit connection between the bottom wall 212 and the side wall 211. In some embodiments, the bottom wall 212 may include a vent hole 2120 that is in communication with the microphone assembly 50 in an air guiding manner, so that the microphone assembly 50 is driven to operate when a negative pressure is generated in the vaporization base 21. In some embodiments, the vaporization base 21 may further include a seal ring 219, and the seal ring 219 is sandwiched between a lower end surface of the side wall 211 and a top surface of the bottom wall 212 to seal a gap therebetween.

Figure 9:
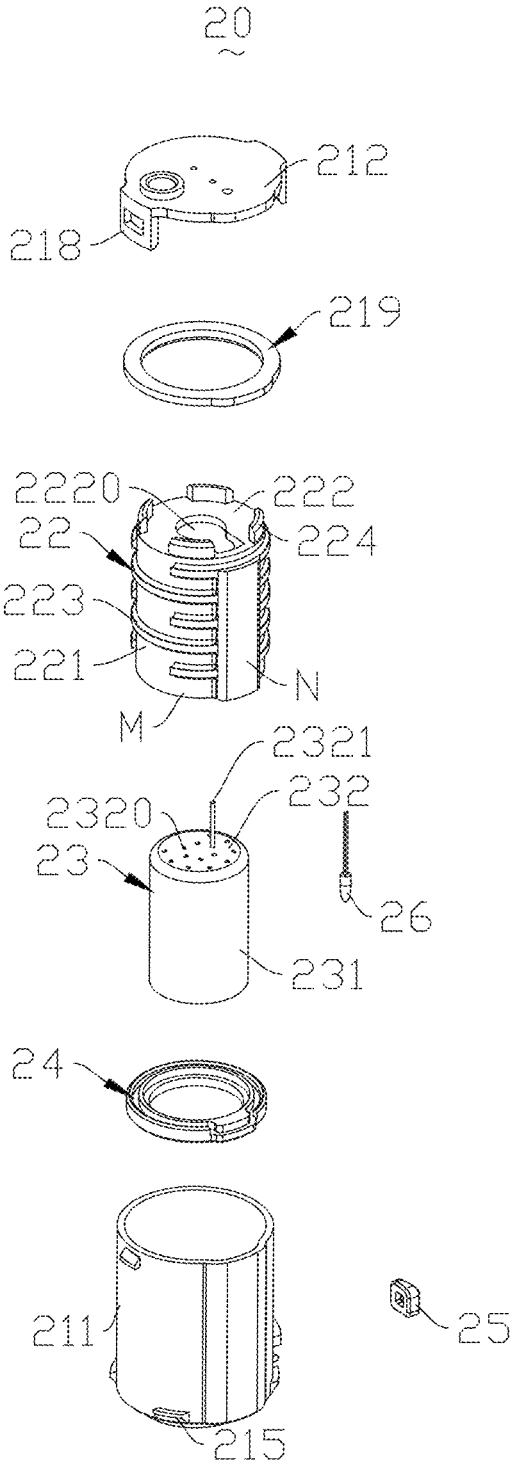
FIG. 9 is a schematic diagram of a three-dimensional exploded structure of the vaporization assembly shown in FIG. 7 from another perspective.
Figure 10:
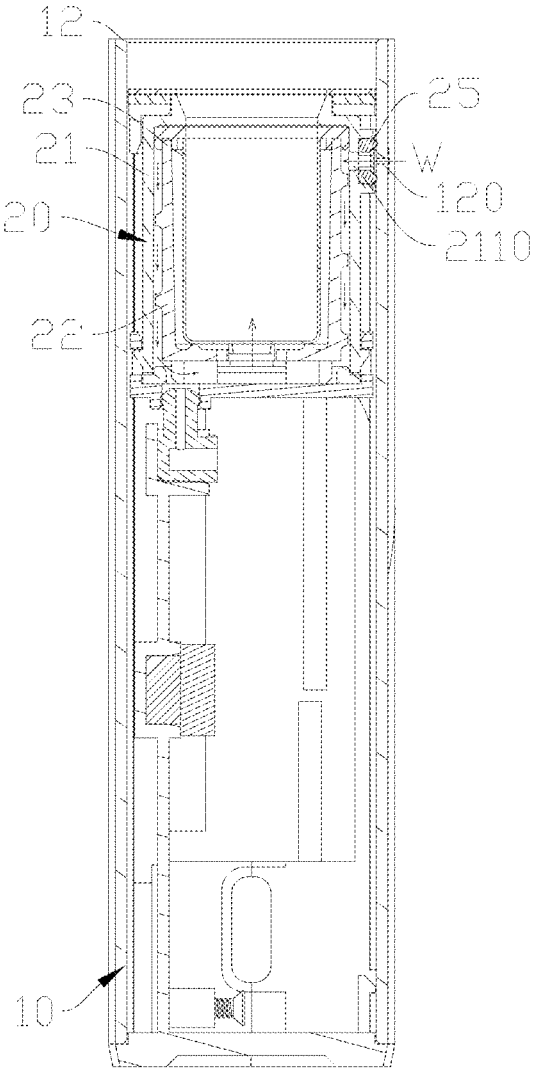
FIG. 10 is a schematic cross-sectional structural diagram in a B-B direction of the electronic vaporization device shown in FIG. 1 with a suction nozzle assembly removed.

As shown in FIG. 7 and FIG. 9, in some embodiments, the heat shield 22 can be made of a ceramic material. The heat shield 22 may include a cylindrical side wall 221, a bottom wall 222 integrally combined with the lower end of the side wall 221, a plurality of ribs 223 that are spaced apart in parallel integrally formed on the longitudinal direction of the outer surface of the side wall 221, and a plurality of legs 224 that are spaced apart integrally formed on a bottom surface of the bottom wall 222. When the heat shield 22 is arranged in the vaporization base 21, the side wall 221 and the ribs 223 together with the side wall 211 of the vaporization base 21 define an S-shaped airflow channel from top to bottom.

In some embodiments, the side wall 221 may include a main body portion M with a C-shaped cross section and a protruding portion N with a U-shaped cross section that is mouth-to-mouth integrally combined with the C-shaped main body portion M. The main body portion M is configured to accommodate the heating pot 23, and the protruding portion N is configured to accommodate the temperature sensing element 26. The bottom wall 222 is configured to support the heating pot 23, and may include an air inlet hole 2220 that is provided in a middle portion and runs through in a longitudinal direction and a thermal insulation protrusion 2222 formed in a middle portion of the top surface of the bottom wall 222. The air inlet hole 2220 is configured to allow the ambient air to enter the heating pot 23. The thermal insulation protrusion 2222 is supported on a bottom surface of the heating pot 23 to reduce a contact area between the heating pot 23 and the heat shield 22 and prevent excessive heat from being transferred to the heat shield 22.

Referring to FIG. 10, each rib 223 extends along the outer surface of the side wall 221 in a circumferential direction, and extends from one side of the protruding portion N through the main body portion M to an other side of the protruding portion N. The ribs 223 form a plurality of C-shaped air guide grooves 2230) extending in a circumferential direction on the outer surface of the side wall 221. A notch 2232 is provided on a side of each rib 223 that is close to the protruding portion N, and the notches 2232 of the adjacent ribs 223 are close to different sides of the protruding portion N. The air guide grooves 2230 are connected end to end to form an S-shaped airflow channel from top to bottom (as shown in an arrow group W in FIG. 10). The S-shaped airflow channel can cover most areas of the outer surface of the side wall 221 of the heat shield 22, so that the ambient air entering from the outside can circulate therein before entering the heating pot 23. The ambient air is in sufficient contact with the surface of the heat shield 22, and on the one hand, the heat shield 22 can be effectively cooled to reduce the heat transferred to the outer surface of the housing 10; and on the other hand, when the heated air enters the heating pot 23 again, the probability of occurrence of the condensation phenomenon in the heating pot 23 can be reduced.

In some embodiments, based on the consideration of the overall size, the rib 223 are not arranged on the outer surface of the protruding portion N. Therefore, the air guide groove is neither provided on the outer surface of the protruding portion N, the ambient air cannot flow through the surface of the protruding portion N, and the temperature of the protruding portion N may be relatively high. However, during assembly, the protruding portion N can be arranged toward the power source device 60, so that the power source device 60 can insulate heat, thereby preventing local heat generation at a position on the housing 10 corresponding to the protruding portion N. It may be understood that, in some embodiments, if the temperature sensing element 26 does not need to be arranged at the protruding portion N, the protruding portion N may not be arranged on the heat shield 22, and is cylindrical as a whole. In this case, the airflow channel can be distributed in an entire circumferential direction of the heat shield 22 to implement better heat dissipation to the heat shield 22.

It can be further understood that the airflow channel on the surface of the heat shield 22 is not limited to the layout shown in the figure. An airflow channel with another layout is also applicable provided that the ambient air can conduct relatively sufficient heat exchange on the outer surface of the heat shield 22 before entering the heating pot 23.

Figure 6:
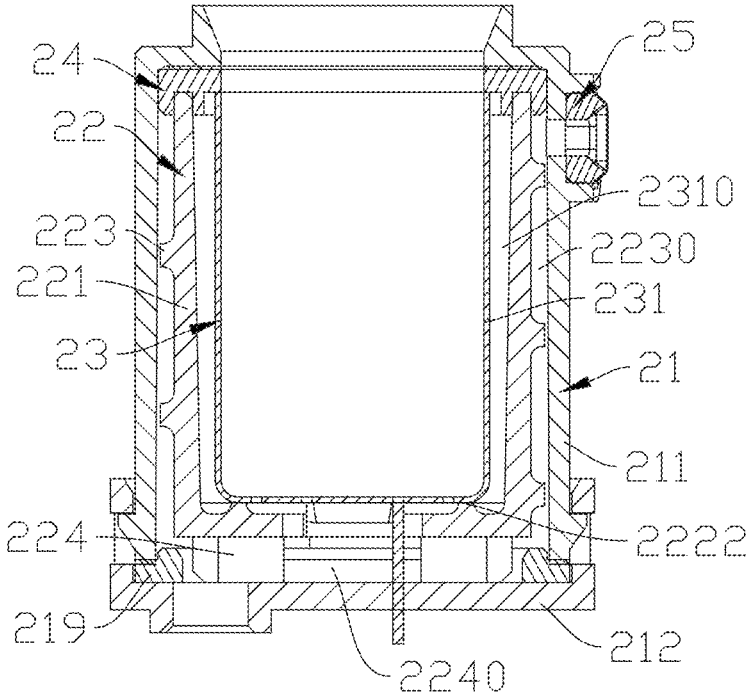
FIG. 6 is a schematic cross-sectional structural diagram in a B-B direction of the vaporization assembly shown in FIG. 5.

As shown in FIG. 6, the legs 224 are configured to support the upper surface of the bottom wall 212 of the vaporization base 21, and gaps 2240 are formed between the adjacent legs 224. The gaps 2240 allow the S-shaped airflow channel to be in communication with the air inlet hole 2220 on the bottom wall 222 of the heat shield 22.

As shown in FIG. 6 to FIG. 9, in some embodiments, the heating pot 23 can be made of stainless steel, a heating circuit can be printed on the outer surface of the heating pot 23 to generate heat, and the heat is conducted into the heating pot 23. In addition, an infrared radiation coating layer 233 can be printed on an inner side of the heating pot 23 to radiate heat to a to-be-heated medium in the pot. As shown in the figure, in some embodiments, the heating pot 23 may include a cylindrical side wall 231 and a bottom wall 232 that is integrally formed at the lower end of the side wall 231. The bottom wall 232 is provided with a plurality of air inlet holes 2320 distributed in a net shape, and the air inlet holes 2320 are in communication with the air inlet hole 2220 of the heat shield 22. An electrode lead 2321 may be connected to the bottom wall 232. When the heating pot 23 is arranged in the heat shield 22, there is a spacing 2310 between the side wall 231 and the side wall 221 of the heat shield 22, so as to cause the air to isolate the side wall 231 and the side wall 221 of the heat shield 22. In this way, the heat on the side wall 231 is reduced to be transferred to the side wall 221 by heat conduction.

As shown in FIG. 1 to FIG. 4, in some embodiments, the suction nozzle assembly 30 may include a suction nozzle base 31 with an air guide channel 310, a bowl-shaped air guide member 32 protruding from a bottom portion of the suction nozzle base 31, and a suction nozzle 33 rotatably connected to a top portion of the suction nozzle base 31. The suction nozzle 33 includes an air guide channel 330 that is in communicated with the air guide channel 310. In some embodiments, the air guide member 32 may include a bottom wall 321 and a side wall 322 that is integrally combined with a periphery of the bottom wall 321. The lower end of the air guide member 32 can be embedded in the neck 214 of the vaporization base 21 to cause an inner cavity of the heating pot 23 to be in air-tight communication with the air guide channel 310 of the suction nozzle base 31. The bottom wall 321 of the air guide member 32 is provided with a plurality of air inlet holes 3210 running through in an up-down direction. The upper end of the side wall 322 is fixed in the bottom wall of the suction nozzle base 31.

It can be understood that the foregoing technical features can be used in any combination without limitation.

The foregoing descriptions are merely embodiments of the present disclosure, and the protection scope of the present disclosure is not limited thereto. All equivalent structure or process changes made according to the content of this specification and accompanying drawings in the present disclosure or by directly or indirectly applying the present disclosure in other related technical fields shall fall within the protection scope of the present disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electronic vaporization device, comprising:

a housing;

a vaporization assembly arranged in the housing, the vaporization assembly comprising a vaporization base;

a heat shield arranged in the vaporization base; and a heating pot arranged in the heat shield, wherein an airflow channel for ambient air to enter the heating pot is formed on an outer surface of the heat shield, wherein the vaporization base comprises a cylindrical first side wall, wherein a first air inlet hole that is in communication with the airflow channel is provided on the cylindrical first side wall and at a position close to an upper end of the cylindrical first side wall, and wherein the housing is provided with a second air inlet hole that is in communication with the first air inlet hole.

2. The electronic vaporization device of claim 1, wherein the airflow channel is distributed over most areas of the outer surface of the heat shield.

3. The electronic vaporization device of claim 1, wherein the airflow channel extends from an upper end to a lower end of the heat shield.

4. The electronic vaporization device of claim 1, wherein the airflow channel is distributed in an S shape on the outer surface of the heat shield.

5. The electronic vaporization device of claim 4, wherein the heat shield comprises a cylindrical second side wall, wherein the airflow channel comprises a plurality of C-shaped air guide grooves spaced apart in parallel in a longitudinal direction of an outer surface of the cylindrical second side wall, and wherein the air guide grooves are connected end to end.

6. The electronic vaporization device of claim 5, wherein the cylindrical second side wall comprises a main body portion with a C-shaped cross section and a protruding portion with a U-shaped cross section that is mouth-to-mouth combined with the main body portion, and wherein the plurality of C-shaped air guide grooves are formed in a longitudinal direction of an outer surface of the main body portion.

7. The electronic vaporization device of claim 6, wherein the vaporization assembly comprises a temperature sensing element, the heating pot comprises a cylindrical third side wall, and the cylindrical third side wall is axially arranged in the cylindrical second side wall, and wherein the temperature sensing element is arranged between the cylindrical third side wall and the cylindrical second side wall and is arranged in a space defined by the protruding portion.

8. The electronic vaporization device of claim 1, wherein an outer surface of the cylindrical first side wall is provided with a seal base surrounding the first air inlet hole, wherein the vaporization assembly comprises a first seal ring embedded in the seal base, and wherein the first seal ring causes the first air inlet hole to be in communication with the second air inlet hole in a sealing and air guiding manner.

9. The electronic vaporization device of claim 1, wherein the vaporization base comprises an annular plate-shaped top wall that is integrally connected to the upper end of the cylindrical first side wall and a plate-shaped bottom wall that is in snap-fit connection to a lower end of the cylindrical first side wall, and wherein the upper end and the lower end of the heat shield respectively abut against the top wall and the bottom wall.

10. The electronic vaporization device of claim 1, wherein the heat shield comprises a cylindrical second side wall and a first bottom wall combined with a lower end of the cylindrical second side wall, and wherein an upper surface of the first bottom wall is provided with a thermal insulation protrusion configured to support the heating pot.

11. The electronic vaporization device of claim 1, wherein the heat shield comprises a cylindrical second side wall, and the heating pot comprises a cylindrical third side wall, and wherein the cylindrical third side wall is axially arranged in the cylindrical second side wall and a spacing is formed between an outer surface of the cylindrical third side wall and an inner surface of the cylindrical second side wall.

12. The electronic vaporization device of claim 1, wherein an outer surface of the heating pot is provided with a heating circuit and an inner surface of the heating pot is provided with an infrared radiation coating layer.

13. The electronic vaporization device of claim 1, further comprising:

a suction nozzle assembly detachably connected to the housing and connected to the heating pot in an air guiding manner.

14. The electronic vaporization device of claim 1, wherein the vaporization assembly is detachably connected to the housing.

15. The electronic vaporization device of claim 14, wherein the vaporization base comprises a cylindrical side wall and a plurality of elongated engagement protrusions with a wedge-shaped cross section, each of the engagement protrusion comprising a helically inclined top surface, and wherein the engagement protrusions are spaced apart in a circumferential direction of an outer wall surface of the cylindrical side wall that is close to an upper end of the cylindrical side wall so as to be detachably and rotatably connected to the housing.

16. The electronic vaporization device of claim 15, wherein the housing comprises a holder, the holder comprises an upper end cap, and a plurality of arc-shaped buckles protrude from a lower side of the upper end cap, and wherein the buckles encircle to be respectively rotatably connected to the plurality of engagement protrusions.

* * * * *